US009624761B2

(12) United States Patent
Hofman

(10) Patent No.: US 9,624,761 B2
(45) Date of Patent: Apr. 18, 2017

(54) OPEN HOLE FRACING SYSTEM

(71) Applicant: Peak Completion Technologies, Inc., Midland, TX (US)

(72) Inventor: Raymond Hofman, Midland, TX (US)

(73) Assignee: Peak Completion Technologies, Midland, TX (US)

( * ) Notice: Subject to any disclaimer, the term of this patent is extended or adjusted under 35 U.S.C. 154(b) by 281 days.

(21) Appl. No.: 14/480,470

(22) Filed: Sep. 8, 2014

(65) Prior Publication Data

US 2015/0107837 A1 Apr. 23, 2015

Related U.S. Application Data

(63) Continuation of application No. 13/089,165, filed on Apr. 18, 2011, now abandoned, which is a (Continued)

(51) Int. Cl.
*E21B 43/26* (2006.01)
*E21B 34/10* (2006.01)
(Continued)

(52) U.S. Cl.
CPC ..... *E21B 43/261* (2013.01); *E21B 21/103* (2013.01); *E21B 34/14* (2013.01);
(Continued)

(58) Field of Classification Search
CPC ..... E21B 43/261; E21B 43/114; E21B 43/14; E21B 43/12; E21B 43/00; E21B 34/14;
(Continued)

(56) References Cited

U.S. PATENT DOCUMENTS 4,335,788 A 6/1982 Murphey et al.
4,516,879 A 5/1985 Berry et al.
(Continued)

FOREIGN PATENT DOCUMENTS

CA 2437678 2/2004

OTHER PUBLICATIONS www.packersplus.com Packers Plus Energy Service.
(Continued)

*Primary Examiner* — Brad Harcourt

(57) ABSTRACT

A method of producing petroleum from at least one open hole in at least one petroleum production zone of a hydrocarbon well comprising the steps of locating a plurality of sliding valves along at least one production tubing; inserting the plurality of sliding valves and the production tubing into the at least one open hole; cementing the plurality of sliding valves in the at least one open hole; opening at least one of the cemented sliding valves; removing at least some of the cement adjacent the opened sliding valves without using jetting tools or cutting tools to establish at least one communication path between the interior of the production tubing and the at least one petroleum production zone; directing a fracing material radially through the at least one sliding valve radially toward the at least one production zone; producing hydrocarbons from the at least one petroleum production zone through the plurality of the sliding valves the cement adjacent to which has been removed.

19 Claims, 12 Drawing Sheets

Related U.S. Application Data continuation of application No. 11/760,728, filed on Jun. 8, 2007, now Pat. No. 7,926,571, which is a continuation-in-part of application No. 11/079,950, filed on Mar. 15, 2005, now Pat. No. 7,267,172.

(51) Int. Cl.

| | |
|---|---|
| ***E21B 21/10*** | (2006.01) |
| ***E21B 34/14*** | (2006.01) |
| ***E21B 43/00*** | (2006.01) |
| ***E21B 43/11*** | (2006.01) |
| ***E21B 43/12*** | (2006.01) |
| ***E21B 43/114*** | (2006.01) |
| ***E21B 43/14*** | (2006.01) |
| *E21B 34/00* | (2006.01) |

(52) U.S. Cl.

CPC ..... *E21B 43/00* (2013.01); *E21B 43/11* (2013.01); *E21B 43/114* (2013.01); *E21B 43/12* (2013.01); *E21B 43/14* (2013.01); *E21B 43/26* (2013.01); *E21B 2034/002* (2013.01); *E21B 2034/007* (2013.01)

(58) Field of Classification Search

CPC ..... E21B 41/103; E21B 43/11; E21B 43/26; E21B 2034/002; E21B 2034/007

See application file for complete search history.

(56) References Cited

U.S. PATENT DOCUMENTS

| | | | | |
|---|---|---|---|---|
| 4,949,788 | A | | 8/1990 | Szarka et al. |
| 5,381,862 | A | | 1/1995 | Szarka et al. |
| 5,425,424 | A | * | 6/1995 | Reinhardt et al. ..... E21B 33/16 166/291 |
| 5,526,880 | A | | 6/1996 | Jordan et al. |
| 5,669,448 | A | | 9/1997 | Minthorn et al. |
| 5,845,712 | A | | 12/1998 | Griffith, Jr. |
| 5,894,888 | A | | 4/1999 | Wiemers et al. |
| 6,047,773 | A | | 4/2000 | Zeltmann et al. |
| 6,176,312 | B1 | | 1/2001 | Tubel et al. |
| 6,196,312 | B1 | | 3/2001 | Collins et al. |
| 6,241,021 | B1 | | 6/2001 | Bowling |
| 6,446,727 | B1 | | 9/2002 | Zemlak et al. |
| 6,460,619 | B1 | | 10/2002 | Braithwaite et al. |
| 6,543,538 | B2 | | 4/2003 | Tolman et al. |
| 6,763,885 | B2 | | 7/2004 | Cavender |
| 6,907,936 | B2 | | 6/2005 | Fehr et al. |
| 6,994,165 | B2 | | 2/2006 | Roane et al. |
| 7,021,384 | B2 | | 4/2006 | Themig |
| 7,096,954 | B2 | | 8/2006 | Weng et al. |
| 7,108,060 | B2 | | 9/2006 | Jones |
| 7,108,067 | B2 | | 9/2006 | Themig et al. |
| 7,225,869 | B2 | | 6/2007 | Willett et al. |
| 2006/0090906 | A1 | | 5/2006 | Themig |
| 2006/0124310 | A1 | | 6/2006 | Lopez de Cardenas et al. |

OTHER PUBLICATIONS www.hallilburton.com Technology * Expertise * Quality * Halliburton.

www.snydertex.com/mesquite/guiberson/htm Mesquite Oil Tools, Inc. "Guberson Retrievable Packers Systems, Univ-Packer V".

www.dresser.com.

Bellinger, C.E.: Horizontal Well in the Devonian Shale Martin County, Kentucky, Society of Petroleum Engineers, 1991 (SPE 23447).

* cited by examiner

OPEN HOLE FRACING SYSTEM

CROSS-REFERENCE TO RELATED APPLICATIONS

This continuation application claims the benefit of U.S. patent application Ser. No. 13/089,165, filed Apr. 18, 2011 which is a continuation of U.S. patent application Ser. No. 11/760,728, filed Jun. 8, 2007 (now U.S. Pat. No. 7,926,571), which is a continuation-in-part of U.S. patent application Ser. No. 11/359,059, filed Feb. 22, 2006 (now U.S. Pat. No. 7,377,322), which is a continuation-in-part application of U.S. patent application Ser. No. 11/079,950, filed Mar. 15, 2005 (now U.S. Pat. No. 7,267,172), each of which is incorporated by reference herein.

BACKGROUND OF THE INVENTION

1. Field of the Invention

This invention relates to a system for fracing producing formations for the production of oil or gas and, more particularly, for fracing in a cemented open hole using sliding valves, which sliding valves may be selectively opened or closed according to the preference of the producer.

2. Description of the Related Art

Fracing is a method to stimulate a subterranean formation to increase the production of fluids, such as oil or natural gas. In hydraulic fracing, a fracing fluid is injected through a well bore into the formation at a pressure and flow rate at least sufficient to overcome the pressure of the reservoir and extend fractures into the formation. The fracing fluid may be of any of a number of different media, including sand and water, bauxite, foam, liquid $CO_2$, nitrogen, etc. The fracing fluid keeps the formation from closing back upon itself when the pressure is released. The objective is for the fracing fluid to provide channels through which the formation fluids, such as oil and gas, can flow into the well bore and be produced.

One of the prior problems with earlier fracing methods is they require cementing of a casing in place and then perforating the casing at the producing zones. This in turn requires packers between various stages of the producing zone. An example of prior art that shows perforating the casing to gain access to the producing zone is shown in U.S. Pat. No. 6,446,727 to Zemlak, assigned to Schlumberger Technology Corporation. The perforating of the casing requires setting off an explosive charge in the producing zone. The explosion used to perforate the casing can many times cause damage to the formation. Plus, once the casing is perforated, then it becomes hard to isolate that particular zone and normally requires the use of packers both above and below the zone.

Another example of producing in the open hole by perforating the casing is shown in U.S. Pat. No. 5,894,888 to Wiemers. One of the problems with Wiemers is the fracing fluid is delivered over the entire production zone and you will not get concentrated pressures in preselected areas of the formation. Once the pipe is perforated, it is very hard to restore and selectively produce certain portions of the zone and not produce other portions of the zone.

When fracing with sand, sand can accumulate and block flow. United States Published Application 2004/0050551 to Jones shows fracing through perforated casing and the use of shunt tubes to give alternate flow paths. Jones does not provide a method for alternately producing different zones or stages of a formation.

One of the methods used in producing horizontal formations is to provide casing in the vertical hole almost to the horizontal zone being produced. At the bottom of the casing, either one or multiple holes extend horizontally. Also, at the bottom of the casing, a liner hanger is set with production tubing then extending into the open hole. Packers are placed between each stage of production in the open hole, with sliding valves along the production tubing opening or closing depending upon the stage being produced. An example is shown in U.S. Published Application 2003/0121663 A1 to Weng, wherein packers separate different zones to be produced with nozzles (referred to as "burst disks") being placed along the production tubing to inject fracing fluid into the formations. However, there are disadvantages to this particular method. The fracing fluid will be delivered the entire length of the production tubing between packers. This means there will not be a concentrated high pressure fluid being delivered to a small area of the formation. Also, the packers are expensive to run and set inside of the open hole in the formation.

Applicant previously worked for Packers Plus Energy Services, Inc., which had a system similar to that shown in Weng. By visiting the Packers Plus website of www.packersplus.com, more information can be gained about Packers Plus and their products. Examples of the technology used by Packers Plus can be found in United States Published Application Nos. 2004/0129422, 2004/0118564, and 2003/0127227. Each of these published patent applications shows packers being used to separate different producing zones. However, the producing zones may be along long lengths of the production tubing, rather than in a concentrated area.

The founders of Packers Plus previously worked for Guiberson, which was acquired by Dresser Industries and later by Halliburton. The techniques used by Packers Plus were previously used by Guiberson/Dresser/Halliburton. Some examples of well completion methods by Halliburton can be found on the website of www.halliburton.com, including the various techniques they utilize. Also, the sister companies of Dresser Industries and Guiberson can be visited on the website of www.dresser.com. Examples of the Guiberson retrievable packer systems can be found on the Mesquite Oil Tool Inc. website of www.snydertex.com/mesquite/guiberson/htm.

None of the prior art known by applicant, including that of his prior employer, utilized cementing production tubing in place in the production zone with sliding valves being selectively located along the production tubing. None of the prior systems show (1) the sliding valve being selectively opened or closed, (2) the cement therearound being removed, and/or (3) selectively fracing with predetermined sliding valves. All of the prior systems known by applicant utilize packers between the various stages to be produced and have fracing fluid injected over a substantial distance of the production tubing in the formation, not at preselected points adjacent the sliding valves.

BRIEF SUMMARY OF THE INVENTION

The invention is a method of producing petroleum from at least one open hole in at least one petroleum production zone of a hydrocarbon well. The method comprising the steps of locating a plurality of sliding valves along at least one production tubing; inserting the plurality of sliding valves and the production tubing into the at least one open hole; cementing the plurality of sliding valves in the at least one open hole; opening at least one of the cemented sliding valves; removing at least some of the cement adjacent the opened sliding valves without using jetting tools or cutting tools to establish at least one communication path between the interior of the production tubing and the at least one petroleum production zone; directing a fracing material radially through the at least one sliding valve radially toward the at least one production zone; producing hydrocarbons from the at least one petroleum production zone through the plurality of the sliding valves the cement adjacent to which has been removed.

According to another aspect of the invention, an open hole fracing system comprises at least one production tubing inserted into the at least one open hole; a plurality of sliding valves located along the at least one production tubing and in the at least one petroleum production zone, each of the sliding valves having radially-orientated openings therethrough; cement adjacent to the plurality of sliding valves; a fluid flowable radially through the openings of the at least one sliding valve to remove at least some of the adjacent cement without using jetting tools or cutting tools; a fracing material flowable radially through the plurality of sliding valves to cause fracturing of the at least one production zone.

DETAILED DESCRIPTION OF THE INVENTION

Figure 1:
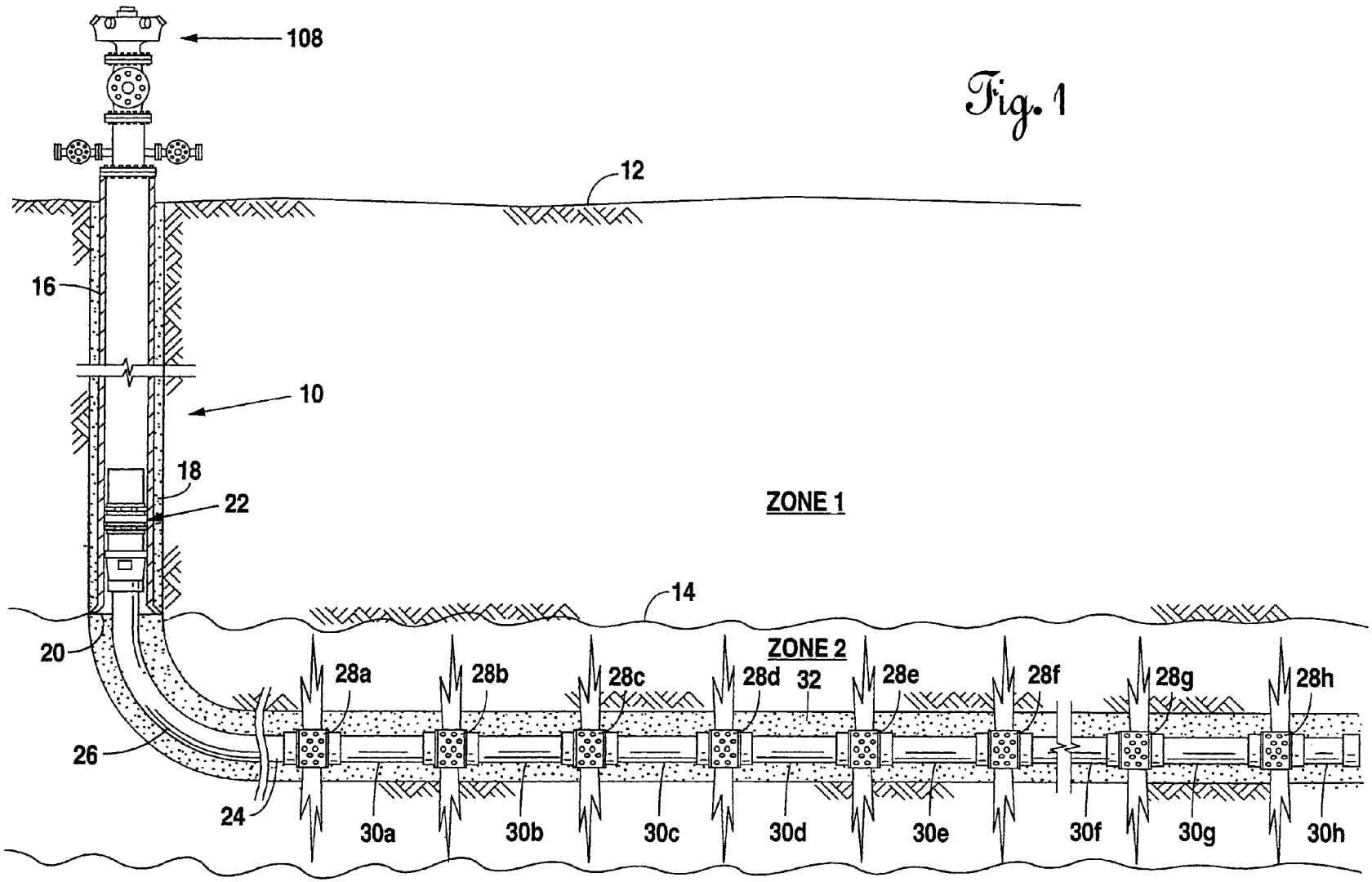
FIG. 1 is a partial sectional view of a well with a cemented open hole fracing system in a lateral located in a producing zone.

A preferred embodiment of an open hole fracing system is pictorially illustrated in FIG. 1. A production well 10 is drilled in the earth 12 to a hydrocarbon production zone 14. A casing 16 is held in place in the production well 10 by cement 18. At the lower end 20 of production casing 16 is located liner hanger 22. Liner hanger 22 may be either hydraulically or mechanically set.

Below liner hanger 22 extends production tubing 24. To extend laterally, the production well 10 and production tubing 24 bends around a radius 26. The radius 26 may vary from well to well and may be as small as thirty feet and as large as four hundred feet. The radius of the bend in production well 10 and production tubing 24 depends upon the formation and equipment used.

Inside of the hydrocarbon production zone 14, the production tubing 24 has a series of sliding valves pictorially illustrated as 28*a*-28*h*. The distance between the sliding valves 28*a*-28*h* may vary according to the preference of the particular operator. A normal distance is the length of a standard production tubing of 30 feet. However, the production tubing segments 30*a*-30*h* may vary in length depending upon where the sliding valves 28 should be located in the formation.

The entire production tubing 24, sliding valves 28*a*-28*h*, and the production tubing segments 30 are all encased in cement 32. Cement 32 located around production tubing 24 may be different from the cement 18 located around the casing 16.

In actual operation, sliding valves 28*a*-28*h* may be selectively opened or closed as will be subsequently described. The sliding valves 28*a*-28*h* may be opened in any order or sequence.

For the purpose of illustration, assume the operator of the production well 10 desires to open sliding valve 28*h*. A mechanical shifting tool 34, such as that shown in FIG. 2, connected on shifting string would be lowered into the production well 10 through casing 16 and production tubing 24. The shifting tool 34 has two elements 34*a*, 34*b* that are identical, except they are reversed in direction and connected by a shifting string segment 38. While the shifting string segment 38 is identical to shifting string 36, shifting string segment 38 provides the distance that is necessary to separate shifting tools 34*a*, 34*b*. Typically, the shifting string segment 38 would be about thirty feet in length.

Figure 3:
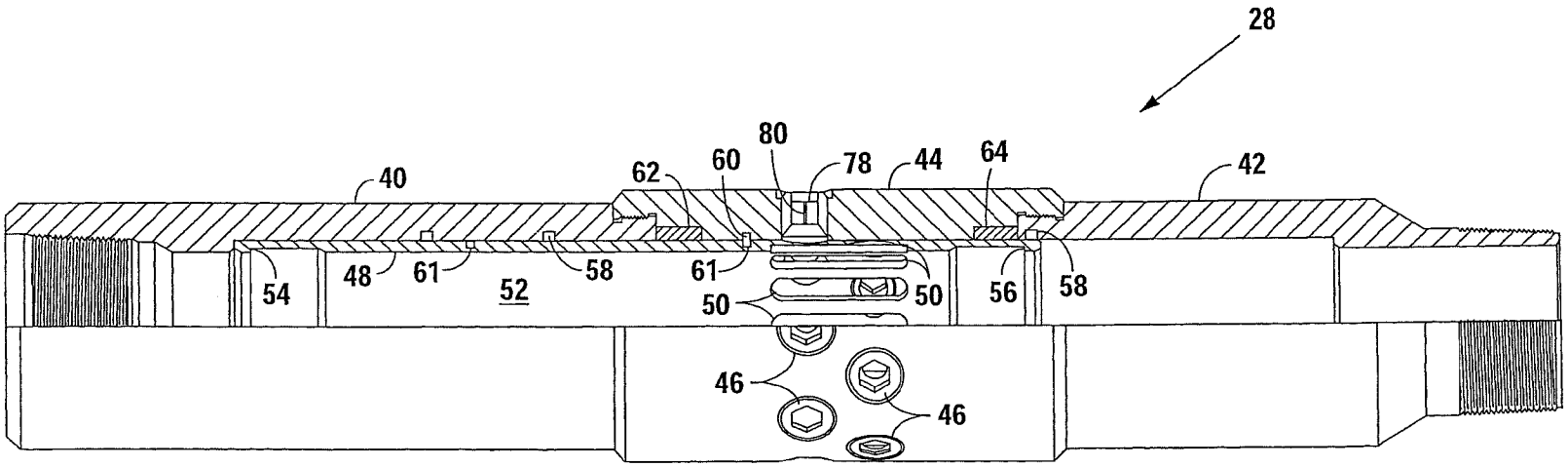
FIG. 3 is an elongated partial sectional view of a sliding valve.

To understand the operation of shifting tool 34 inside sliding valves 28*a*-28*h*, an explanation as to how the shifting tool 34 and sliding valves 28*a*-28*h* work internally is necessary. Referring to FIG. 3, a partial cross-sectional view of the sliding valve 28 is shown. An upper housing sub 40 is connected to a lower housing sub 42 by threaded connections via the nozzle body 44. A series of nozzles 46 extend through the nozzle body 44. Inside of the upper housing sub 40, lower housing sub 42, and nozzle body 44 is an inner sleeve 48. Inside of the inner sleeve 48 are slots 50 that allow fluid communication from the inside passage 52 through the slots 50 and nozzles 46 to the outside of the sliding valve 28. The inner sleeve 48 has an opening shoulder 54 and a closing shoulder 56 located therein.

Figure 4:
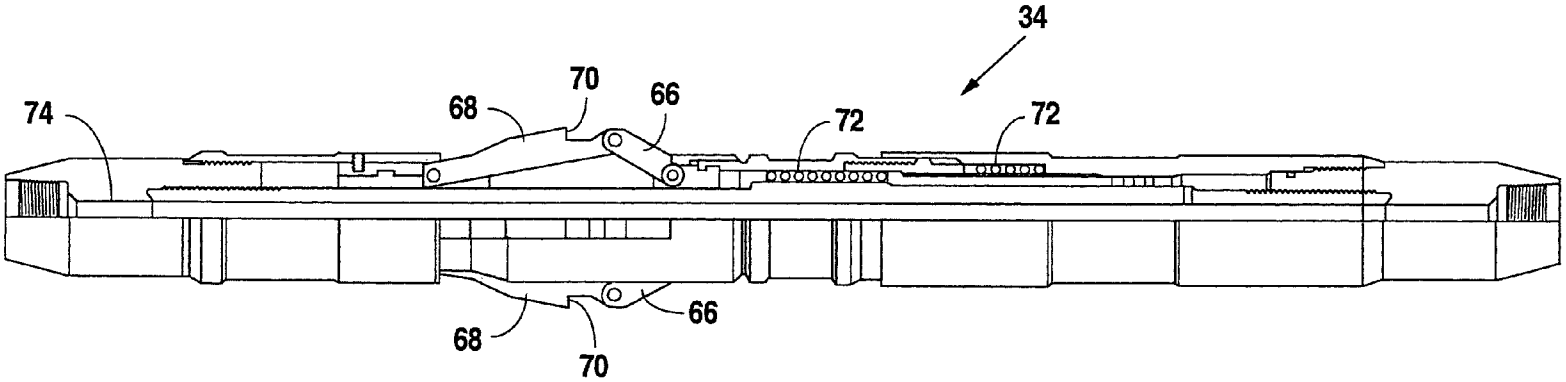
FIG. 4 is an elongated partial sectional view of a single mechanical shifting tool.

When the shifting tool 34 shown in FIG. 4 goes into the sliding valve 28, shifting tool 34*a* performs the closing function and shifting tool 34*b* performs the opening function. Shifting tools 34*a* and 34*b* are identical, except reverse and connected through the shifting string segment 38.

Figure 5A:
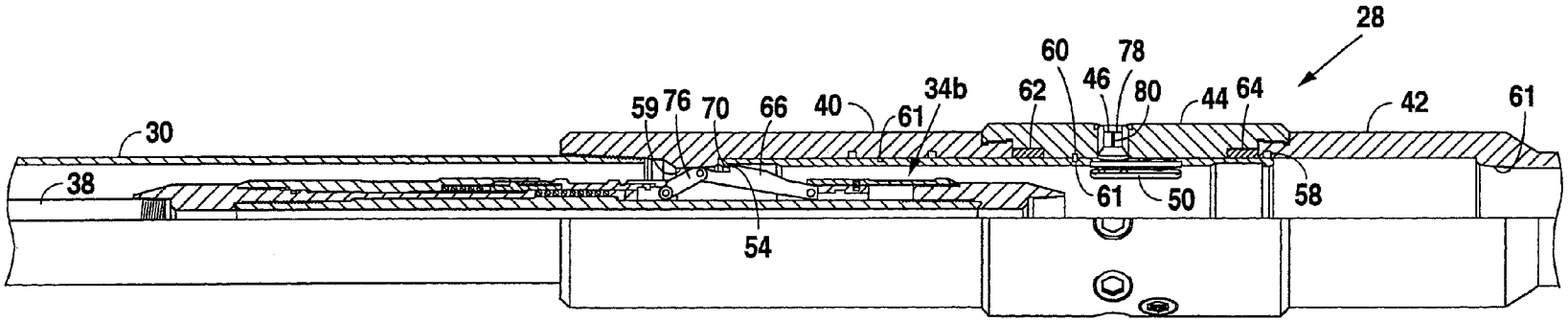
FIG. 5A is an elongated partial sectional view illustrating a mechanical shifting tool opening the sliding valve.

Assume the shifting tool 34 is lowered into production well 10 through the casing 16 and into the production tubing 24. Thereafter, the shifting tool 34 will go around the radius 26 through the shifting valves 28 and production pipe segments 30. Once the shifting tool 34*b* extends beyond the last sliding valve 28*h*, the shifting tool 34*b* may be pulled back in the opposite direction as illustrated in FIG. 5A to open the sliding valve 28, as will be explained in more detail subsequently.

Referring to FIG. 3, the sliding valve 28 has wiper seals 58 between the inner sleeve 48 and the upper housing sub 42 and the lower housing sub 44. The wiper seals 58 keep debris from getting back behind the inner sleeve 48, which could interfere with its operation. This is particularly important when sand is part of the fracing fluid.

Also located between the inner sleeve 48 and nozzle body 44 is a C-clamp 60 that fits in a notch undercut in the nozzle body 44 and into a C-clamp notch 61 in the outer surface of inner sleeve 48. The C-clamp puts pressure in the notches and prevents the inner sleeve 48 from being accidentally moved from the opened to closed position or vice versa, as the shifting tool is moving there through.

Also, seal stacks 62 and 64 are compressed between (1) the upper housing sub 40 and nozzle body 44 and (2) lower housing sub 42 and nozzle body 44, respectively. The seal stacks 62, 64 are compressed in place and prevent leakage from the inner passage 52 to the area outside sliding valve 28 when the sliding valve 28 is closed.

Turning now to the mechanical shifting tool 34, an enlarged partial cross-sectional view is shown in FIG. 4. Selective keys 66 extend outward from the shifting tool 34. Typically, a plurality of selective keys 66, such as four, would be contained in any shifting tool 34, though the number of selective keys 66 may vary. The selective keys 66 are spring loaded so they normally will extend outward from the shifting tool 34 as is illustrated in FIG. 4. The selective keys 66 have a beveled slope 68 on one side to push the selective keys 66 in, if moving in a first direction to engage the beveled slope 68, and a notch 70 to engage any shoulders, if moving in the opposite direction. Also, because the selective keys 66 are moved outward by spring 72, by applying proper pressure inside passage 74, the force of spring 72 can be overcome and the selective keys 66 may be retracted by fluid pressure applied from the surface.

Referring now to FIG. 5A, assume the opening shifting tool 34*b* has been lowered through sliding valve 28 and thereafter the direction reversed. Upon reversing the direction of the shifting tool 34*b*, the notch 70 in the shifting tool will engage the opening shoulder 54 of the inner sleeve 48 of sliding valve 28. This will cause the inner sleeve 48 to move from a closed position to an opened position as is illustrated in FIG. 5A. This allows fluid in the inside passage 58 to flow through slots 50 and nozzles 46 into the formation around sliding valve 28. As the inner sleeve 48 moves into the position as shown in FIG. 5A, C-clamp 60 will hold the inner sleeve 48 in position to prevent accidental shifting by engaging one of two C-clamp notches 61. Also, as the inner sleeve 48 reaches its open position and C-clamp 60 engages, simultaneously the inner diameter 59 of the upper housing sub 40 presses against the slope 76 of the selective key 66, thereby causing the selective keys 66 to move inward and notch 70 to disengage from the opening shoulder 54.

Figure 5B:
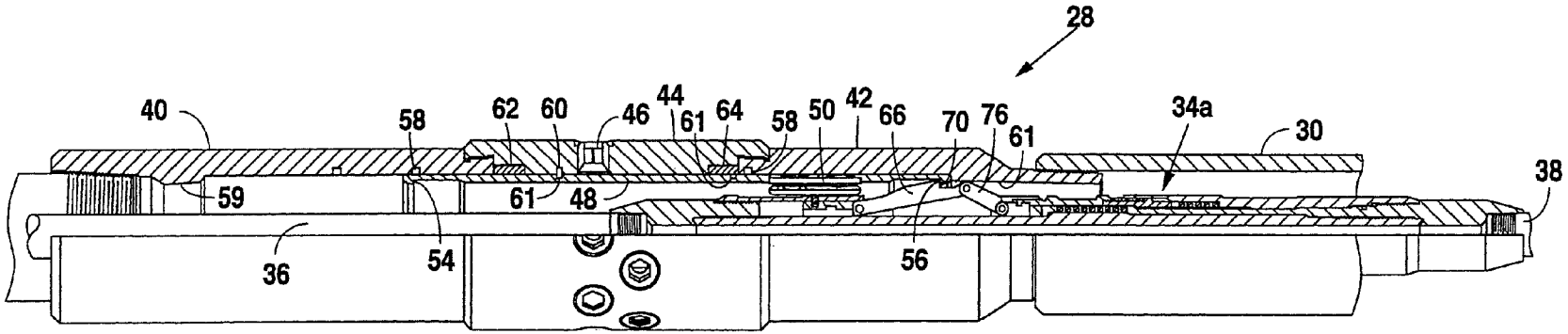
FIG. 5B is an elongated partial sectional view illustrating a mechanical shifting tool closing the sliding valve.

If it is desired to close a sliding valve 28, the same type of shifting tool will be used, but in the reverse direction, as illustrated in FIG. 5B. The shifting tool 34*a* is arranged in the opposite direction so that now the notch 70 in the selective keys 66 will engage closing shoulder 56 of the inner sleeve 48. Therefore, as the shifting tool 34*a* is lowered through the sliding valve 28, as shown in FIG. 5B, the inner sleeve 48 is moved to its lowermost position and flow between the slots 50 and nozzles 46 is terminated. The seal stacks 62 and 64 insure there is no leakage. Wiper seals 58 keep the crud from getting behind the inner sleeve 48.

Also, as the shifting tool 34A moves the inner sleeve 48 to its lowermost position, pressure is exerted on the slope 76 by the inner diameter 61 of lower housing sub 42 of the selective keys 66 to disengage the notch 70 from the closing shoulder 56. Simultaneously, the C-clamp 60 engages in another C-clamp notch 61 in the outer surface of the inner sleeve 48.

Figure 2:
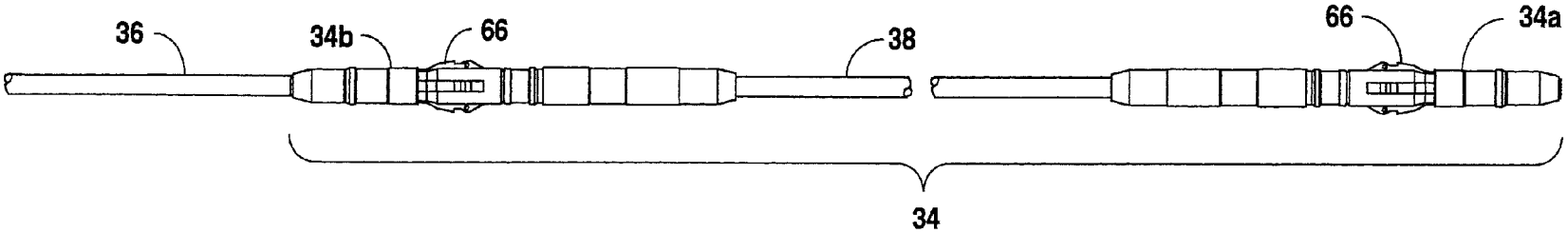
FIG. 2 is a longitudinal view of a mechanical shifting tool.

If the shifting tool 34, as shown in FIG. 2, was run into the production well 10 as shown in FIG. 1, the shifting tool 34 and shifting string 36 would go through the internal diameter of casing 16, internal opening of hanger liner 22, through the internal diameter of production tubing 24, as well as through sliding valves 28 and production pipe segments 30.

Pressure could be applied to the internal passage 74 of shifting tool 34 through the shifting string 36 to overcome the pressure of springs 72 and to retract the selective keys 66 as the shifting tool 34 is being inserted. However, on the other hand, even without an internal pressure, the shifting tool 34*b*, due to the beveled slope 68, would not engage any of the sliding valves 28*a*-28*h* as it is being inserted. On the other hand, the shifting tool 34*a* would engage each of the sliding valves 28 and make sure the inner sleeve 48 is moved to the closed position. After the shifting tool 34*b* extends through sliding valve 28*h*, shifting tool 34*b* can be moved back towards the surface causing the sliding valve 28*h* to open. At that time, the operator of the well can send fracing fluid through the annulus between the production tubing 24 and the shifting string 36. Normally, an acid would be sent down first to dissolve the acid-soluble cement 32 around sliding valve 28 (see FIG. 1). After dissolving the cement 32, the operator has the option to frac around sliding valve 28*h*, or the operator may elect to dissolve the cement around other sliding valves 28*a*-28*g*. Alternatively, the dissolving of the cement could also occur contemporaneously with the fracing process by using a fracing material having acidic properties.

Normally, after dissolving the cement 32 around sliding valve 28*h*, then shifting tool 34*a* would be inserted there through, which closes sliding valve 28*h*. At that point, the system would be pressure checked to insure sliding valve 28*h* was in fact closed. By maintaining the pressure, the selective keys 66 in the shifting tool 34 will remain retracted and the shifting tool 34 can be moved to shifting valve 28*g*. The process is now repeated for shifting valve 28*g*, so that shifting tool 34*b* will open sliding valve 28*g*. Thereafter, the cement 32 is dissolved, sliding valve 28*g* closed, and again the system pressure checked to insure valve 28*g* is closed. This process is repeated until each of the sliding valves 28*a*-28*h* has been opened, the cement dissolved (or otherwise removed), pressure checked after closing, and now the system is ready for fracing.

By determining the depth from the surface, the operator can tell exactly which sliding valve 28*a*-28*h* is being opened. By selecting the combination the operator wants to open, then fracing fluid can be pumped through casing 16, production tubing 24, sliding valves 28, and production tubing segments 30 into the formation.

By having a very limited area around the sliding valve 28 that is subject to fracing, the operator now gets fracing deeper into the formation with less fracing fluid. The increase in the depth of the fracing results in an increase in production of oil or gas. The cement 32 between the respective sliding valves 28*a*-28*h* confines the fracing fluids to the areas immediately adjacent to the sliding valves 28*a*-28*h* that are open.

Any particular combination of the sliding valves 28*a*-28*h* can be selected. The operator at the surface can tell when the shifting tool 34 goes through which sliding valves 28*a*-28*h* by the depth and increased force as the respective sliding valve is being opened or closed.

Applicant has just described one way of shifting the sliding sleeves used within the system of the present invention. Other types of shifting devices may be used including electrical, hydraulic, or other mechanical designs. While mechanical shifting using a shifting tool 34 is tried and proven, other designs may be useful depending on how the operator wants to produce the well. For example, the operator may not want to separately dissolve the cement 32 around each sliding valve 28*a*-28*h*, and pressure check, prior to fracing. The operator may want to open every third sliding valve 28, dissolve the cement, then frac. Depending upon the operator preference, some other type shifting device may be easily be used.

Another aspect of the invention is to prevent debris from getting inside sliding valves 28 when the sliding valves 28 are being cemented into place inside of the open hole. To prevent the debris from flowing inside the sliding valve 28, a plug 78 is located in nozzle 46. The plug 78 can be dissolved by the same acid that is used to dissolve the cement 32. For example, if a hydrochloric acid is used, by having a weep hole 80 through an aluminum plug 78, the aluminum plug 78 will quickly be eaten up by the hydrochloric acid. However, to prevent wear at the nozzles 46, the area around the aluminum plus 78 is normally made of titanium. The titanium resists wear from fracing fluids, such as sand.

While the use of plug 78 has been described, plugs 78 may not be necessary. If the sliding valves 28 are closed and the cement 32 does not stick to the inner sleeve 48, plugs 78 may be unnecessary. It all depends on whether the cement 32 will stick to the inner sleeve 48.

Further, the nozzle 46 may be hardened any of a number of ways instead of making the nozzles 46 out of titanium. The nozzles 46 may be (a) heat treated, (b) frac hardened, (c) made out of tungsten carbide, (d) made out of hardened stainless steel, or (e) made or treated any of a number of different ways to decrease and increase productive life.

Figure 6:
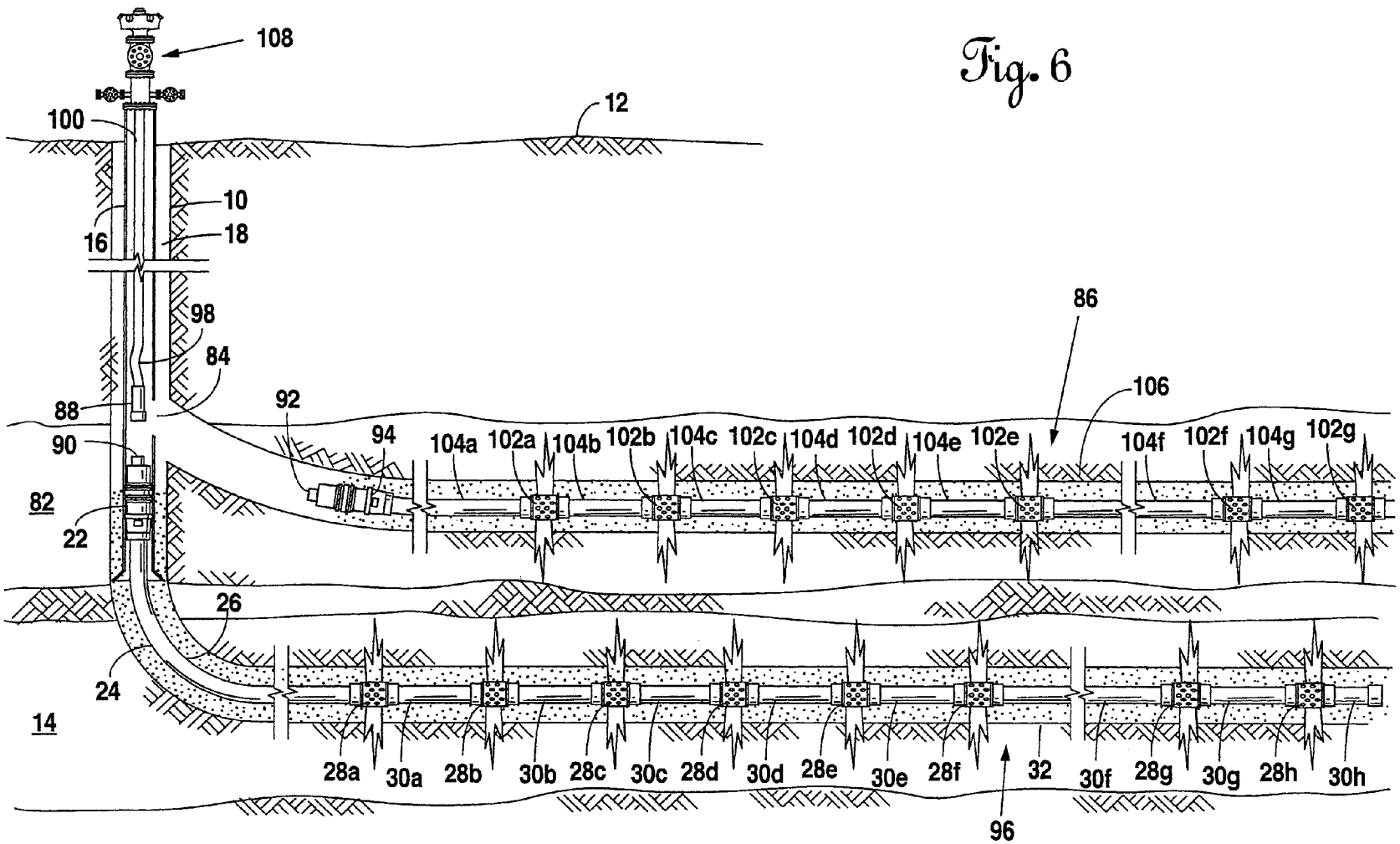
FIG. 6 is a pictorial sectional view of a cemented open hole fracing system having multiple laterals.

Assume the system as just described is used in a multilateral formation as shown in FIG. 6. Again, the production well 10 is drilled into the earth 12 and into a hydrocarbon production zone 14, but also into hydrocarbon production zone 82. Again, a liner hanger 22 holds the production tubing 24 that is bent around a radius 26 and connects to sliding valves 28*a*-28*h*, via production pipe segments 30*a*-30*h*. The production of zone 14, as illustrated in FIG. 6, is the same as the production as illustrated in FIG. 1. However, a window 84 has now been cut in casing 16 and cement 18 so that a horizontal lateral 86 may be drilled there through into hydrocarbon production zone 82.

In the drilling of wells with multiple laterals, or multilateral wells, an on/off tool 88 is used to connect to the stinger 90 on the liner hanger 22 or the stinger 92 on packer 94. Packer 94 can be either a hydraulic set or mechanical set packer to the wall 81 of the horizontal lateral 86. In determining which lateral 86, 96 to which the operator is going to connect, a bend 98 in the vertical production tubing 100 helps guide the on/off tool 88 to the proper lateral 86 or 96. The sliding valves 102*a*-102*g* may be identical to the sliding valves 28*a*-28*h*. The only difference is sliding valves 102*a*-102*g* are located in hydrocarbon production zone 82, which is drilled through the window 84 of the casing 16. Sliding valves 102*a*-102*g* and production tubing 104*a*-104*g* are cemented into place past the packer 94 in the same manner as previously described in conjunction with FIG. 1. Also, the sliding valves 102*a*-102*g* are opened in the same manner as sliding valves 28*a*-28*h* as described in conjunction with FIG. 1. Also, the cement 106 may be dissolved in the same manner.

Just as the multi laterals as described in FIG. 6 are shown in hydrocarbon production zones 14 and 82, there may be other laterals drilled in the same zones 14 and/or 82. There is no restriction on the number of laterals that can be drilled nor in the number of zones that can be drilled. Any particular sliding valve may be operated, the cement dissolved, and fracing begun. Any particular sliding valve the operator wants to open can be opened for fracing deep into the formation adjacent the sliding valve.

By use of the system as just described, more pressure can be created in a smaller zone for fracing than is possible with prior systems. Also, the size of the tubulars is not decreased the further down in the well the fluid flows. Although ball-operated valves may be used with alternative embodiments of the present invention, the decreasing size of tubulars is a particular problem for a series of ball operated valves, each successive ball-operated valve being smaller in diameter. This means the same fluid flow can be created in the last sliding valve at the end of the string as would be created in the first sliding valve along the string. Hence, the flow rates can be maintained for any of the selected sliding valves 28*a*-28*h* or 102*a*-102*g*. This results in the use of less fracing fluid, yet fracing deeper into the formation at a uniform pressure regardless of which sliding valve through which fracing may be occurring. Also, the operator has the option of fracing any combination or number of sliding valves at the same time or shutting off other sliding valves that may be producing undesirables, such as water.

Figure 7:
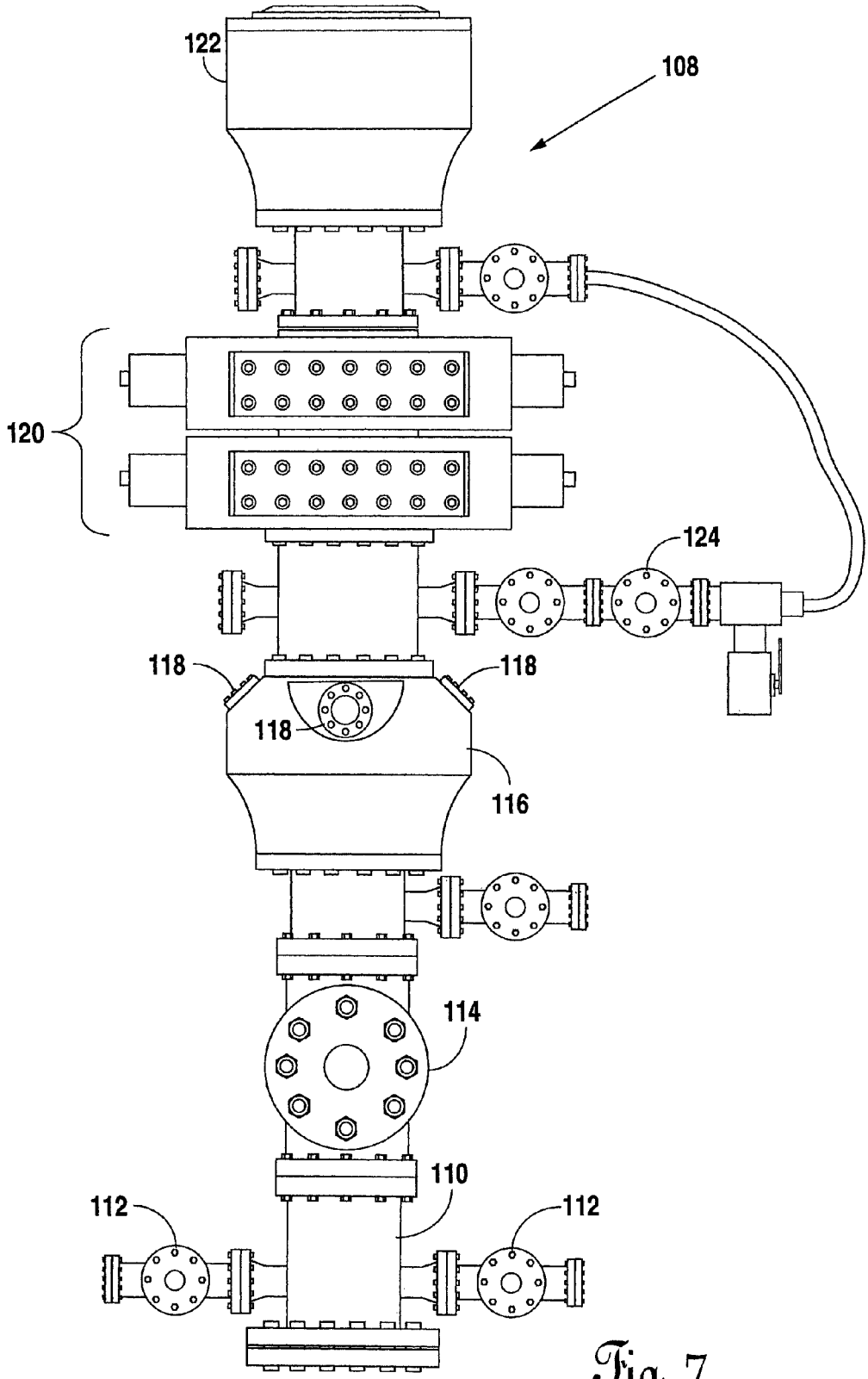
FIG. 7 is an elevated view of a wellhead.

On the top of casing 18 of production well 10 is located a wellhead 108. While many different types of wellheads are available, the wellhead preferred by applicant is illustrated in further detail in FIG. 7. A flange 110 is used to connect to the casing 16 that extends out of the production well 10. On the sides of the flange 110 are standard valves 112 that can be used to check the pressure in the well, or can be used to pump things into the well. A master valve 114 that is basically a float control valve provides a way to shut off the well in case of an emergency. Above the master valve 114 is a goat head 116. This particular goat head 116 has four points of entry 118, whereby fracing fluids, acidizing fluids or other fluids can be pumped into the well. Because sand is many times used as a fracing fluid and is very abrasive, the goat head 116 is modified so sand that is injected at an angle to not excessively wear the goat head. However, by adjusting the flow rate and/or size of the opening, a standard goat head may be used without undue wear.

Above the goat head 116 is located blowout preventer 120, which is standard in the industry. If the well starts to blow, the blowout preventer 120 drives two rams together and squeezes the pipe closed. Above the blowout preventer 120 is located the annular preventer 122. The annular preventer 122 is basically a big balloon squashed around the pipe to keep the pressure in the well bore from escaping to atmosphere. The annular preventer 122 allows access to the well so that pipe or tubing can be moved up and down there through. The equalizing valve 124 allows the pressure to be equalized above and below the blow out preventer 120. The equalizing of pressure is necessary to be able to move the pipe up and down for entry into the wellhead. All parts of the wellhead 108 are old, except the modification of the goat head 116 to provide injection of sand at an angle to prevent excessive wear. Even this modification is not necessary by controlling the flow rate.

Figure 8:
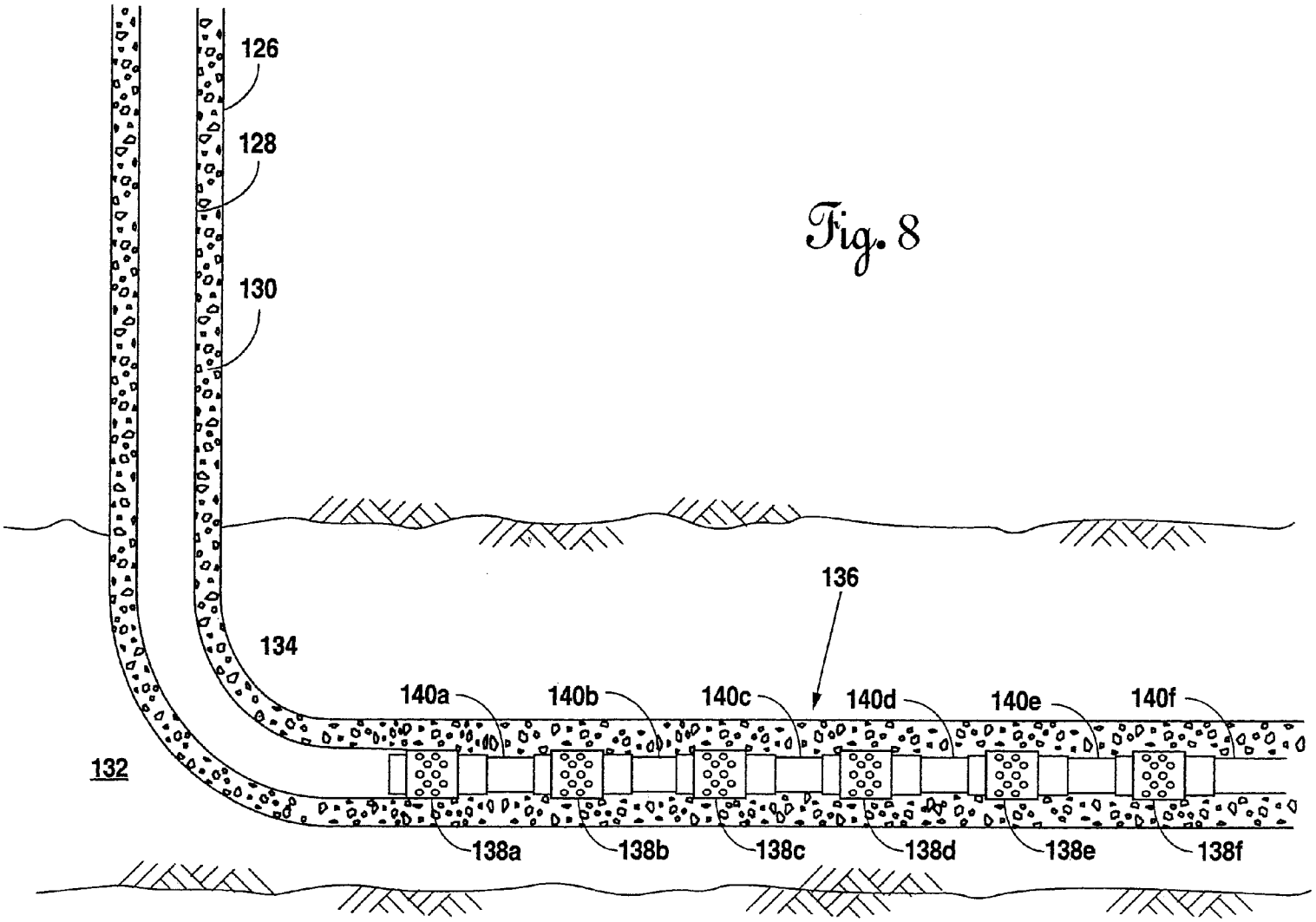
FIG. 8 is a cemented open hole horizontal fracing system.

Turning now to FIG. 8, the system as presently described has been installed in a well 126 without vertical casing. Well 126 has production tubing 128 held into place by cement 130. In the production zone 132, the production tubing 128 bends around radius 134 into a horizontal lateral 136 that follows the production zone 132. The production tubing 128 extends into production zone 132 around the radius 134 and connects to sliding valves 138*a*-138*f*, through production tubing segments 140*a*-140*f*. Again, the sliding valves 138*a*-138*f* may be operated so the cement 130 is dissolved therearound. Thereafter (or simultaneously therewith, such as when the fracing material has dissolving properties), any of a combination of sliding valves 138*a*-138*f* can be operated and the production zone 132 fraced around the opened sliding valve. In this type of system, it is not necessary to cement into place a casing nor is it necessary to use any type of packer or liner hanger. The minimum amount of hardware is permanently connected in well 126, yet fracing throughout the production zone 132 in any particular order as selected by the operator can be accomplished by simply fracing through the selected sliding valves 138*a*-138*f*.

Figure 9:
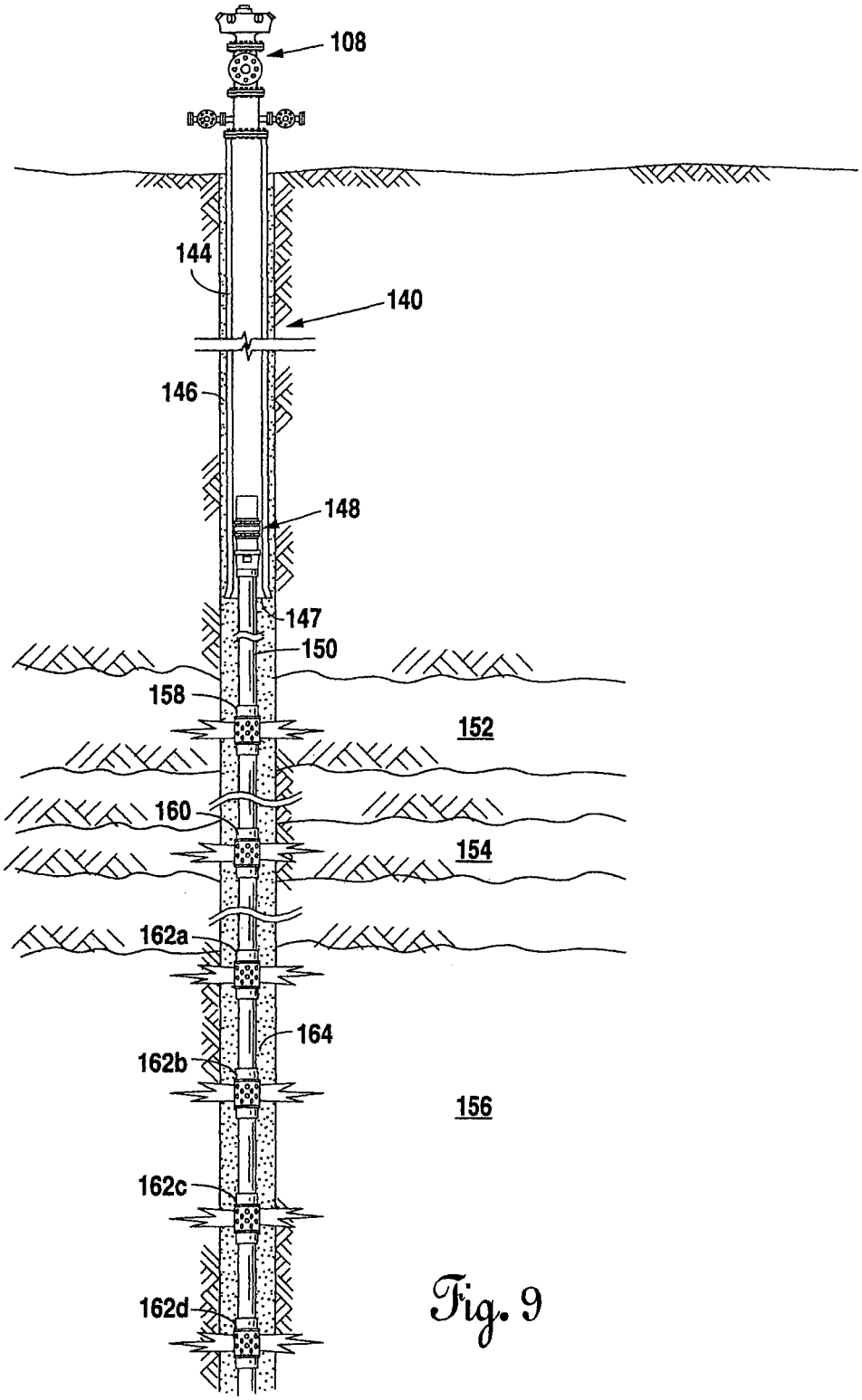
FIG. 9 is a cemented open hole vertical fracing system.

The system previously described can also be used for an entirely vertical well 140 as shown in FIG. 9. The wellhead 108 connects to casing 144 that is cemented into place by cement 146. At the bottom 147 of casing 144 is located a liner hanger 148. Below liner hanger 148 is production tubing 150. In the well 140, as shown in FIG. 9, there are producing zones 152, 154, and 156. After the production tubing 150 and sliding valves 158, 160, and 162*a*-162*d* are cemented into place by acid soluble cement 164, the operator may now produce all or selected zones. For example, by dissolving the cement 164 adjacent sliding valve 158, thereafter, production zone 152 can be fraced and produced through sliding valve 158. Likewise, the operator could dissolve the cement 164 around sliding valve 160 that is located in production zone 154. After dissolving the cement 164 around sliding valve 160, production zone 154 can be fraced and later produced.

On the other hand, if the operator wants to have multiple sliding valves 162*a*-162*d* operate in production zone 156, the operator can operate all or any combination of the sliding valves 162*a*-162*d*, dissolve the cement 164 therearound, and later frac through all or any combination of the sliding valves 162*a*-162*d*. By use of the method as just described, the operator can produce whichever zone 152, 154 or 156 the operator desires with any combination of selected sliding valves 158, 160 or 162.

Figure 10A:
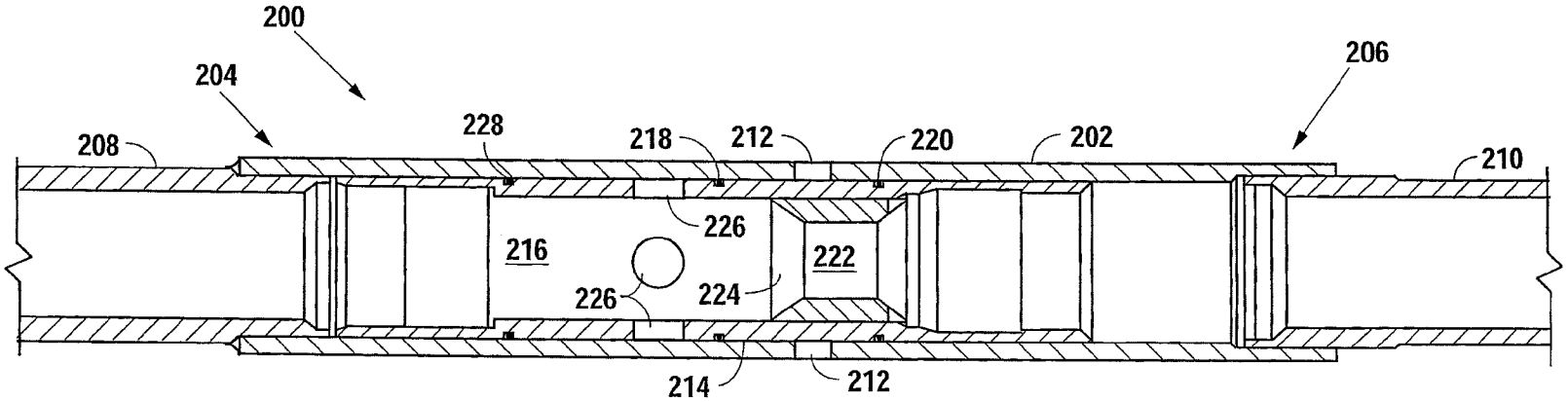
FIG. 10A is an elongated partial sectional view illustrating a ball-and-seat sliding valve in the "opened" position.
Figure 10B:
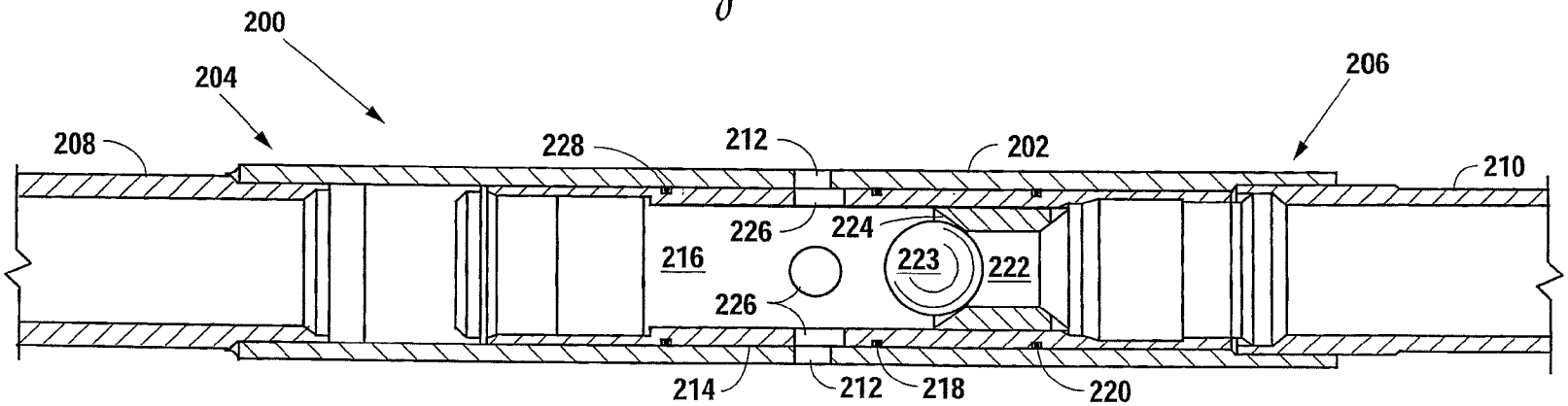
FIG. 10B is an elongated partial sectional view illustrating a ball-and seat sliding valve in the "closed" position.

Alternative embodiments of the present invention may include any number of sliding sleeve variants, such as a hydraulically actuated ball-and-seat valve 200 shown in FIGS. 10A and 10B. More specifically, FIG. 10A discloses a ball-and-seat valve 200 that has a mandrel 202 threadedly engaged at its upper end 204 with an upper sub 208 and at the lower end 206 with lower sub 210, respectively, attachable to production tubing segments (not shown). The mandrel 202 has a series of mandrel ports 212 providing a fluid communication path between the exterior of the ball-and-seat valve 200 to the interior of the mandrel 202.

FIG. 10A shows the ball-and-seat valve 200 in a "closed" position, wherein the fluid communication paths through the mandrel ports 212 are blocked by a lower portion 214 of the outer surface of an inner sleeve 216, which lower portion 214 is defined by a middle seal 218 and a lower seal 220, respectively. The middle seal 218 and lower seal 220 encircle the inner sleeve 216 to substantially prevent fluid from flowing between the outer surface of the inner sleeve 216 to the mandrel ports 212 in the mandrel 202.

The inner sleeve 216 is cylindrical with open ends to allow fluid communication through the interior thereof. The inner sleeve 216 further contains a cylindrical ball seat 222 opened at both ends and connected to the inner sleeve 216. When the ball-and-seat valve 200 is closed as shown in FIG. 10A, fluid may be communicated through the inner sleeve 216 and cylindrical ball seat 222 affixed thereto in either the upwell or downwell direction.

FIG. 10B shows the ball-and-seat valve 200 in an "open" position. When the ball-and-seat valve 200 is to be selectively opened, a ball 223 sealable to a seating surface 224 of the cylindrical ball seat 222 is pumped into the ball-and-seat valve 200 from the upper sub 208. The ball 223 is sized such that the cylindrical ball seat 222 impedes further movement of the ball 223 through the ball-and-seat valve 200 as the ball 223 contacts the seating surface 224 and seals the interior of the seat 222 from fluid communication therethrough. In other words, the sealing of the ball 223 to the ball seat 222 prevents fluid from flowing downwell past the ball-and-seat valve 200.

To open the ball-and-seat valve 200—in other words, to move the inner sleeve 216 to the "open" position—downward flow within the production tubing (not shown) is maintained. Because fluid cannot move through the seat 222 because the ball 223 is in sealing contact with the seating surface 224 thereof, pressure upwell from the ball 223 may be increased to force the ball 223, and therefore the inner sleeve 216, downwell until further movement of the inner sleeve 216 is impeded by contacting the lower sub 210.

As shown in FIG. 10B, when the inner sleeve 216 is in the "open" positioned, a series of sleeve ports 226 provide a fluid communication path between the exterior and interior of the inner sleeve 216 and are aligned with the mandrel ports 212 to permit fluid communication therethrough from and to the interior of the ball-and-seat valve 200, and more specifically to the interior of the inner sleeve 216. When the ball-and-seat valve 200 is "open," fluid communication to and from the interior of the ball-and-seat valve 200 other than through the mandrel ports 212 and sleeve ports 226 is prevented by an upper seal 228 and the middle seal 218 encircling the outer surface of the inner sleeve 216. The ball-and-seat valve 200 may thereafter be closed through the use of conventional means, such as a mechanical shifting tool lowered through the production tubing, as described with reference to the preferred embodiment.

When multiple ball-and-seat valves are used in a production well, each of the ball-and-seat valves will have a ball seat sized differently from the ball seats of the other valves used in the same production tubing. Moreover, the valve with the largest diameter ball seat will be located furthest upwell, and the valve with the smallest diameter ball seat will be located furthest downwell. Because the size of the seating surface of each ball seat is designed to mate and seal to a particularly-sized ball, valves are chosen and positioned within the production string so that balls will flow through any larger-sized, upwell ball seats until the appropriately-sized seat is reached. When the appropriately-sized ball seat is reached, the ball will mate and seal to the seat, blocking any upwell-to-downwell fluid flow as described hereinabove. Thus, when selectively opening multiple ball-and-seat valves within a production string, the valve furthest downwell is typically first opened, then the next furthest, and so on.

Figure 11A:
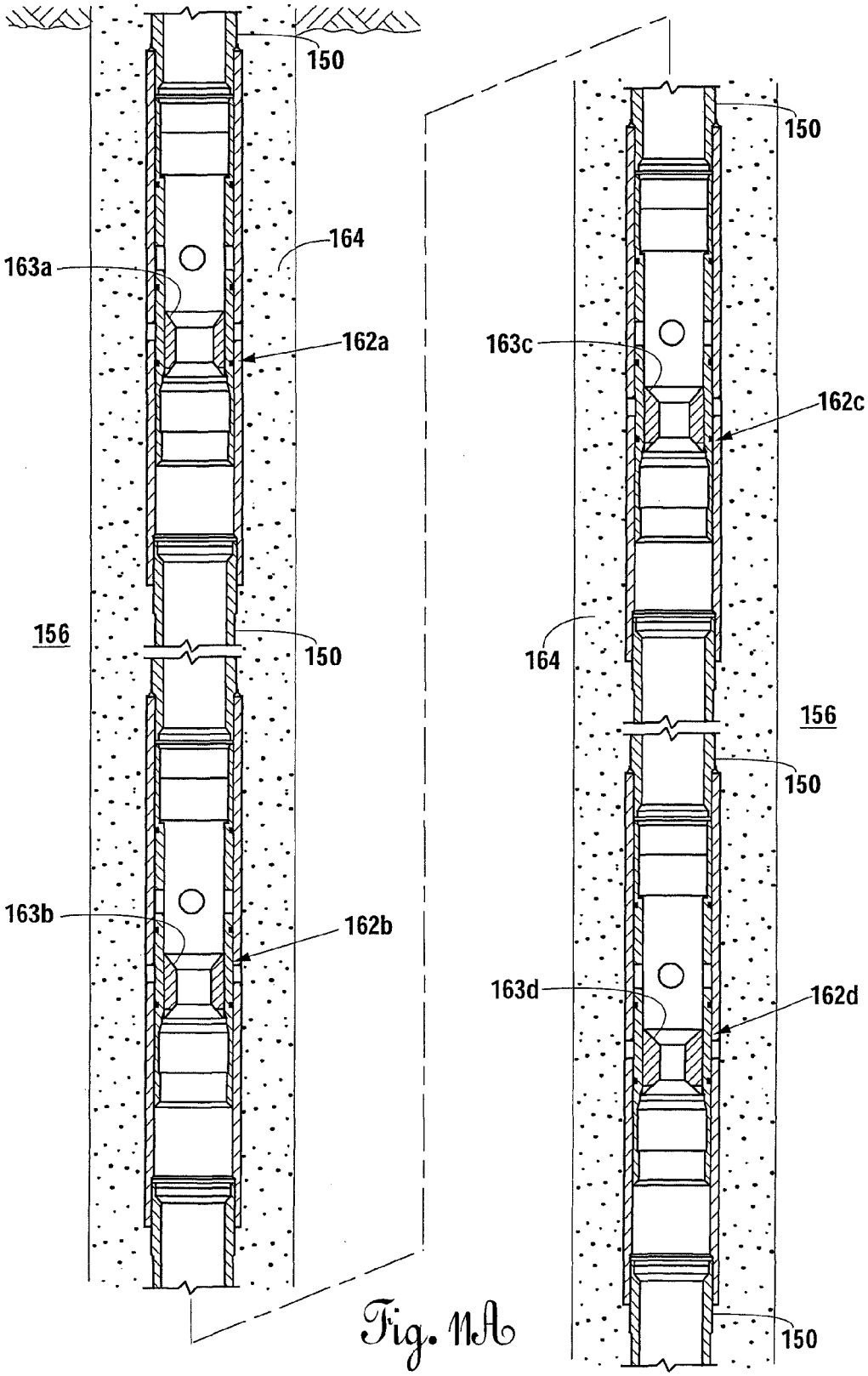
FIGS. 11A-11C are enlarged sectional views of the valves of the cemented open hole vertical fracing system shown in FIG. 9 that disclose in more detail how the ball-and-seat sliding valves are selectively opened and closed.
Figure 11B:
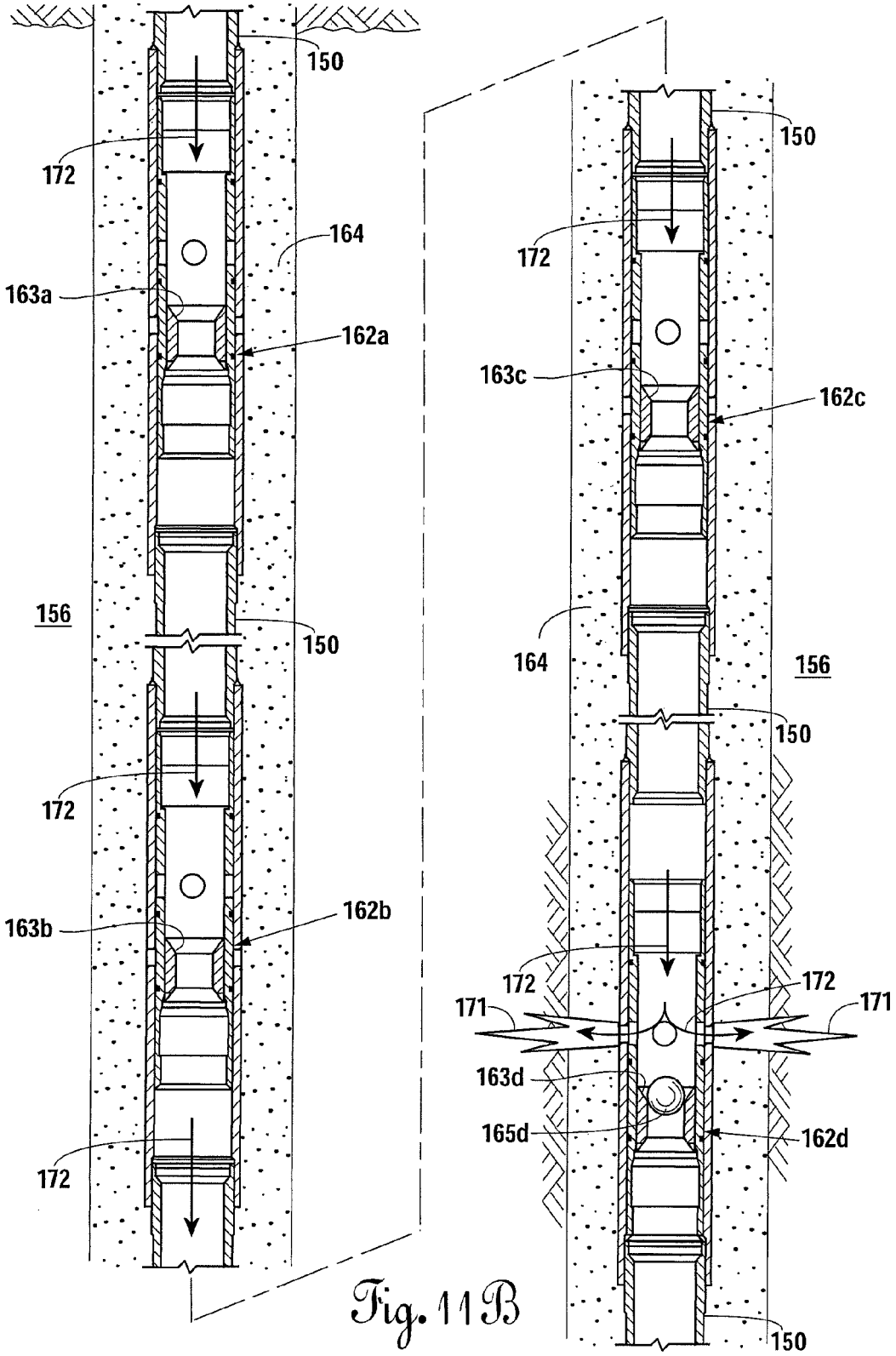
Figure 11C:
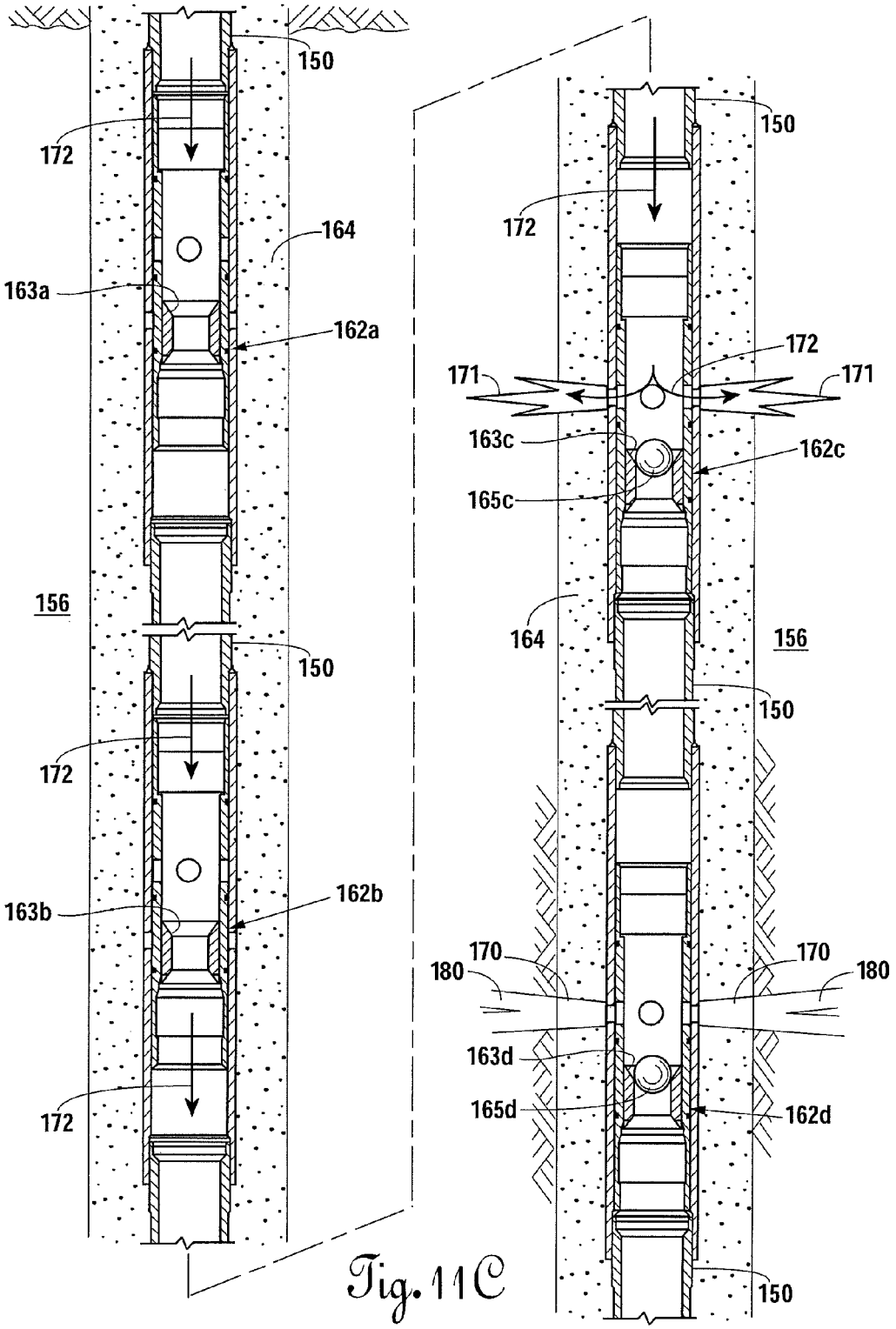

Referring to FIGS. 11A-11C in sequence, and by way of example, assume that the production well shown in FIG. 9 uses four ball-and-seat valves 162*a*-162*d* in the production zone 156. As shown in FIG. 11A, further assume that the ball-and-seat valves 162*a*-162*d* are sized as follows: The deepest ball-and-seat valve 162*d* has a ball seat 163*d* with an inner diameter of 1.36" and matable to a ball (not shown) having a 1.50" diameter; the next deepest ball-and-seat valve 162*c* has a ball seat 163*c* with an inner diameter of 1.86" and matable to a ball (not shown) having a 2.00" diameter; the next deepest valve 162*b* has a ball seat 163*b* with an inner diameter of 2.36" and matable to a ball (not shown) having a 2.50" diameter; and the shallowest ball-and-seat valve 162*a* has a ball seat 163*a* with an inner diameter of 2.86" and matable to a ball (not shown) having a 3.00" diameter. The ball-and-seat valves 162*a*-162*d* are connected with segments of production tubing 150. The ball-and-seat valves 162*a*-162*d* and production tubing 150 are cemented into place in an open hole with cement 164.

As shown in FIG. 11B, to open the deepest valve 162*d*, a ball 165*d* having a 1.50" diameter is pumped through the production tubing 150 and shallower ball-and-seat valves 162*a*-162*c*. Because the 1.50" diameter of the ball 165*d* is smaller than the inner diameters of each of the ball seats 163*a*-163*c* of the other valves 162*a*-162*c*—which are 2.86", 2.36", and 1.86", respectively—the ball 165*d* will flow in a downwell direction 172 through each of the shallower ball-and-seat valves 162*a*-162*c* until further downwell movement is impeded by the smaller 1.36" diameter ball seat 163*d* of the deepest ball-and-seat valve 162*d*. At that point, if the ball-and-seat valve 162*d* is in the closed position (see FIG. 10A), fluid pressure within the production tubing 150 may be increased to selectively open the ball-and-seat valve 162*d* as previously described with reference to FIG. 10B hereinabove. After selectively opening the deepest ball-and-seat valve 162*d*, the cement 164 adjacent thereto may be dissolved with a solvent 171 and the production zone 156 can be fraced and produced through ball-and-seat valve 162*d*, as previously described. As shown in FIG. 11C, dissolving the cement 164 adjacent thereto leaves passages 170 through which fracing material may be forced into cracks 180 in the production zone 156 and through which oil from the surrounding production zone 156 may be produced.

Further referring to FIG. 11C, to open the next deepest ball-and-seat valve 162*c*, a ball 165*c* having a 2.00" diameter is pumped through the production tubing 150 and two shallower ball-and-seat valves 162*a*, 162*b*. Because the 2.00" diameter of the ball 165*c* is smaller than the inner diameters of the two shallower ball-and-seat valves 162*a*, 162*b*—which are 2.86" and 2.36", respectively—the ball 165*c* will flow in a downwell direction 172 through each of the ball-and-seat valves 162*a*, 162*b* until further downwell movement is impeded by the smaller 1.86" diameter ball seat 163*c* of the second deepest valve 162*c*. If the ball-and-seat valve 162*c* is closed, fluid pressure within the production tubing 150 may be increased to selectively open the ball-and-seat valve 162*c* as previously described with reference to FIG. 10B hereinabove. After selectively opening the ball-and-seat valve 162*c*, the cement 164 adjacent thereto may be dissolved and the production zone 156 can be fraced and produced through ball-and-seat valve 162*c*. This process may be repeated until all desired valves within the production well have been selectively opened and fraced and/or produced.

After having been pumped into the production well to selectively trigger corresponding ball-and-seat sliding valves, the balls may be pumped from the production well during production by reversing the direction of flow. Alternatively, seated balls may be milled, and thus fractured such that the pieces of the balls return to the well surface and may be retrieved therefrom.

By use of the method as described, the operator, by cementing the sliding valves into the open hole and thereafter dissolving the cement, can frac just in the area adjacent to the sliding valve. By having a limited area of fracing, more pressure can be built up into the formation with less fracing fluid, thereby causing deeper fracing into the formation. Such deeper fracing will increase the production from the formation. Also, the fracing fluid is not wasted by distributing fracing fluid over a long area of the well, which results in less pressure forcing the fracing fluid deep into the formation. In fracing over long areas of the well, there is less desirable fracing than what would be the case with the present invention.

The present invention shows a method of fracing in the open hole through cemented in place sliding valves that can be selectively opened or closed depending upon where the production is to occur. Preliminary experiments have shown that the present system described hereinabove produces better fracing and better production at lower cost than prior methods.

The present invention is described above in terms of a preferred illustrative embodiment of a specifically described cemented open-hole selective fracing system and method, as well as an alternative embodiment of the present invention. Those skilled in the art will recognize that other alternative embodiments of such a system and method can be used in carrying out the present invention. Other aspects, features, and advantages of the present invention may be obtained from a study of this disclosure and the drawings, along with the appended claims.

I claim:

1. A method of treating an open hole in a subterranean formation, the method comprising:

flowing a fluid into a production tubing in the open hole, the production tubing encased in cement and comprising:

one or more sliding valves located therealong, said sliding valves preventing fluid communication between the interior of the production tubing and the cement encasing the production tubing;

said sliding valves each comprising a housing with openings therethrough, the openings being substantially co-radial with the adjacent portions of said housing;

opening at least one of said sliding valves; and penetrating the cement encasing the production tubing adjacent said opened at least one sliding valve with said fluid without using jetting tools or cutting tools to establish at least one communication path between the interior of said production tubing and said subterranean formation;

increasing the pressure of the fluid in the at least one production tubing to a pressure sufficient to fracture said petroleum producing zone;

wherein said fluid comprises a solvent and at least a portion of said cement encasing the production tubing is soluble in said solvent.

2. The method of claim 1 wherein at least one of said sliding valves comprises a ball seat;

the fluid contains a ball capable of forming a fluid seal with the ball seat; and the opening step comprises creating a pressure differential across the ball seat.

3. The method of claim 1 wherein the steps of claim 1 are repeated for at least 2 of said sliding valves.

4. The method of claim 1 wherein said penetrating step and said increasing step are at least substantially contemporaneous.

5. The method of claim 1 wherein the penetrating step comprises causing a physical change to at least a portion of said cement, said physical change resulting from interaction of the cement with a component of said fluid.

6. The method of claim 5 wherein said causing step comprises dissolving at least some of said cement adjacent said opened sliding valves using the fluid.

7. The method of claim 1 wherein the fluid comprises an acid.

8. The method of claim 1 further comprising the step of directing a second fluid through said at least one sliding valve toward the subterranean formation.

9. The method of claim 1 wherein the penetrating step comprises removing at least some of said cement.

10. A method of preparing an open hole well for fracing in a least one petroleum production zone formation in which a production tubing is inserted into the open hole well and cement is pumped through the production tubing into the open hole well, positioned in an annulus between the open hole well and the production tubing, and allowed to cure in the annulus so that the production tubing is held permanently in place, the method comprising:

as the production tubing is inserted into the open hole well, providing one or more sliding valves to be positioned at predetermined locations along said production tubing, said one or more sliding valves being selectively shiftable from a closed position to an open position and having one or more openings that enable communication of fluid flow from within the sliding valve to an outside of the sliding valve when shifted open and being configured to be shiftable in a cemented environment;

recording the location along said production tubing where said one or more sliding valves is positioned along said production tubing;

identifying a sliding valve along said production tubing that is to be shifted to an open position and identifying its respective location along said production tubing in said well, wherein when said identified sliding valves is shifted to an open position said formation may be fraced with a fracing fluid in said production tubing and forced out of said one or more sliding valves using pressure to penetrate said cement and create a communication path through said cement into said formation without the use of jetting or cutting tools such that the cement surrounding the communication path acts to focus said fluid into a face of said formation.

11. The method of claim 10 wherein said one or more sliding valves to be positioned at predetermined locations along said production tubing each further comprises a housing surrounding an inner shifting sleeve shiftable from a first position to a second position when said sliding valve is shifted from a closed position to an open position and one or more seals positioned around said shifting sleeve between said shifting sleeve and said housing to inhibit debris from moving past said seals and interfering with a shifting operation.

12. The method of claim 10 wherein said one or more sliding valves to be positioned at predetermined locations along said production tubing each further comprises a housing surrounding an inner shifting sleeve shiftable from a first position to a second position when said sliding valve is shifted from a closed position to an open position and one or more seal stacks positioned around said shifting sleeve between said shifting sleeve and said housing to inhibit leakage from within the sliding valve to an area outside of the sliding valve when the sliding valve is in a closed position.

13. The method of claim 11 wherein said one or more sliding valves to be positioned at predetermined locations along said production tubing each further comprises a ball seat and said sliding valve is shifted open when said ball seat receives a ball and a pressure differential is created across said ball seat sufficient to shift said sliding valve to an open position and further comprising the step of providing a ball dimensioned to be received by said ball seat of said identified sliding valve to create a seal across said ball seat to enable said pressure differential across said ball seat.

14. A method of treating an open hole in a subterranean formation, the method comprising:

flowing a fluid into a production tubing in the open hole, the production tubing encased in cement and comprising:

one or more sliding valves located therealong, said sliding valves preventing fluid communication between the interior of the production tubing and the cement encasing the production tubing;

said sliding valves each comprising a housing with openings therethrough, the openings being substantially co-radial with the adjacent portions of said housing;

opening at least one of said sliding valves; and penetrating the cement encasing the production tubing adjacent said opened at least one sliding valve with said fluid without using jetting tools or cutting tools to establish at least one communication path between the interior of said production tubing and said petroleum producing zone;

increasing the pressure of the fluid in the at least one production tubing to a pressure sufficient to fracture said subterranean formation;

wherein said penetrating step and said increasing step are at least substantially contemporaneous.

15. The method of claim 14 wherein the penetrating step comprises causing a physical change to at least a portion of said cement, said physical change resulting from interaction of the cement with a component of said fluid.

16. The method of claim 15 wherein said causing step comprises dissolving at least some of said cement adjacent said opened sliding valves using the fluid.

17. The method of claim 14 further comprising the step of directing a second fluid through said at least one sliding valve toward the subterranean formation.

18. The method of claim 14 wherein the fluid comprises an acid.

19. The method of claim 14 wherein the penetrating step comprises removing at least some of said cement.

* * * * *